US006223355B1

(12) United States Patent
Irving

(10) Patent No.: US 6,223,355 B1
(45) Date of Patent: May 1, 2001

(54) NOVELTY DECORATIVE HAT

(76) Inventor: Milton C. Irving, 3212-d Regents Park La., Greensboro, NC (US) 27455

( * ) Notice: Subject to any disclaimer, the term of this patent is extended or adjusted under 35 U.S.C. 154(b) by 0 days.

(21) Appl. No.: 09/532,949

(22) Filed: Mar. 22, 2000

Related U.S. Application Data

(60) Provisional application No. 60/126,324, filed on Mar. 26, 1999.

(51) Int. Cl.[7] ..... A42B 19/02

(52) U.S. Cl. ..... 2/171; 2/906; 362/106

(58) Field of Search ..... 2/171, 171.02, 2/209.13, 175.1, 195.1, 905, 906, 171.04; 362/103, 106

(56) References Cited

U.S. PATENT DOCUMENTS

| | | | | |
|---|---|---|---|---|
| D. 214,012 | | 5/1969 | Russo . | |
| D. 318,338 | * | 7/1991 | Mitchell | D26/39 |
| 4,665,568 | * | 5/1987 | Stutes | 2/209.2 |
| 4,817,212 | * | 4/1989 | Benoit | 2/209.2 |
| 5,111,366 | * | 5/1992 | Rife et al. | 362/31 |
| 5,243,707 | | 9/1993 | Bodinet . | |
| 5,404,593 | * | 4/1995 | Kronenberger | 2/195.1 |
| 5,485,358 | * | 1/1996 | Chien | 362/106 |
| 5,510,961 | * | 4/1996 | Peng | 362/106 |
| 5,680,718 | | 10/1997 | Ratcliffe et al. . | |
| 5,738,431 | | 4/1998 | Lary . | |
| 6,007,212 | * | 12/1999 | Chan | 362/106 |
| 6,032,293 | * | 3/2000 | Makki | 2/209.13 |
| 6,047,407 | * | 4/2000 | Habel | 2/244 |

FOREIGN PATENT DOCUMENTS 9631730 10/1996 (WO) .

* cited by examiner

*Primary Examiner*—John J. Calvert
*Assistant Examiner*—Katherine Moran
(74) *Attorney, Agent, or Firm*—Richard C. Litman

(57) ABSTRACT

The present invention is a decorative hat generally defined by a body portion, a plurality of decorative lights, a D.C. electrical power source, electrical circuitry, and a switching means. A mouth is formed in one end of the body portion for fitting over a person's head. The plurality of decorative lights are attached to the outside of the body portion for forming an illuminated decorative display on the outside of the body portion. The electrical power source is attached to the inside of the body portion for providing a source of electrical power inside the hat. The plurality of decorative lights and the electrical power source are each attached to and electrically coupled to the electrical circuitry for enabling the electrical power source to supply electrical power to the decorative lights.

10 Claims, 3 Drawing Sheets

NOVELTY DECORATIVE HAT

CROSS-REFERENCE TO RELATED APPLICATION

This application claims the benefit of U.S. Provisional Patent Application Ser. No. 60/126,324, filed Mar. 26, 1999.

BACKGROUND OF THE INVENTION

1. Field of the Invention

The present invention relates generally to a decorative hat and, more particularly, to a decorative hat having battery-operated lights attached a body portion.

2. Description of Related Art

Hats are worn for a number of different reasons. For example some hats are worn to provide warmth to a wearer's head. Other hats are worn, particularly by women, for aesthetic reasons. Still other hats are also worn to display messages. In particular, hats are sometimes worn to indicate loyalties to particular teams in a number of different sports, both at the amateur and professional levels. Additionally, hats are worn for novelty reasons or strictly decorative purposes.

Several patents illustrate the aforementioned known hat types. U.S. Pat. No. Des. 214,012 issued to Russo discloses an illuminable hat. U.S. Pat. No. Des. 318,338 issued to Mitchell on Jul. 16, 1991 discloses a design for an illuminated cap. U.S. Pat. No. 5,243,707 issued to Bodinet on Sep. 14, 1993 discloses an inflatable hat that may be provided in any of a number of novelty shapes, forms, colors, designs, and the like. U.S. Pat. No. 5,680,718 issued to Ratcliff et al. on Oct. 28, 1997 discloses an illuminable hat. U.S. Pat. No. 5,738,431 issued to Lary on Apr. 14, 1998 discloses a cap with a removable halogen light. International application number WO 96/31730 issued to Mami M. Hurwitz discloses an illuminated protective hat that includes at least one electroluminescent lamp secured to a shell of the hat.

However, none of the aforementioned inventions disclose a decorative hat having a plurality of decorative lights and a D.C. power source for creating an illuminated display on the hat. None of the above inventions and patents, taken either singly or in combination, is seen to describe the instant invention as claimed.

SUMMARY OF THE INVENTION

The present invention is a decorative hat generally having a body portion, a plurality of decorative lights, a D.C. electrical power source, electrical circuitry, and a switching means. A mouth is formed in one end of the body portion for fitting over a person's head. The plurality of decorative lights are attached to the outside of the body portion for forming an illuminated decorative display on the outside of the body portion. The electrical power source is attached to the inside of the body portion for providing a source of electrical power inside the hat. The plurality of decorative lights and the electrical power source are each attached to and electrically coupled to the electrical circuitry for enabling the electrical power source to supply electrical power to the decorative lights.

Accordingly, it is a principal object of the invention to provide a decorative hat having a battery pack electrically connected to a plurality of decorative lights formed on the outside of the hat for creating an illuminated display on the decorative hat.

It is another object of the invention to provide a decorative hat comprising a plurality of decorative lights, a battery module, and a switching means formed therein for selectively creating an illuminated decorative display on the decorative hat.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
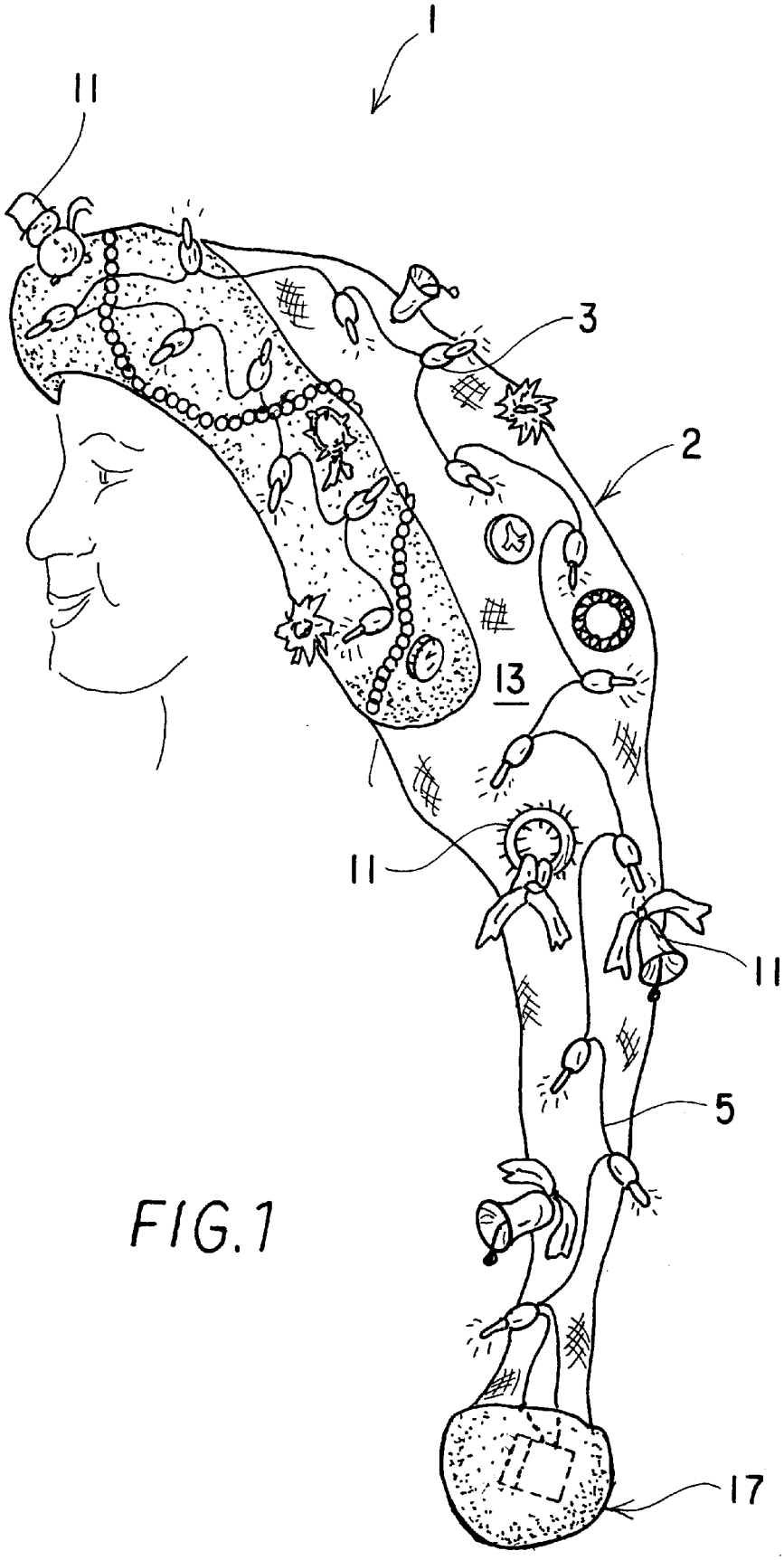
FIG. 1 is an environmental, elevational view of a novelty hat according to a preferred embodiment of the present invention.
Figure 2:
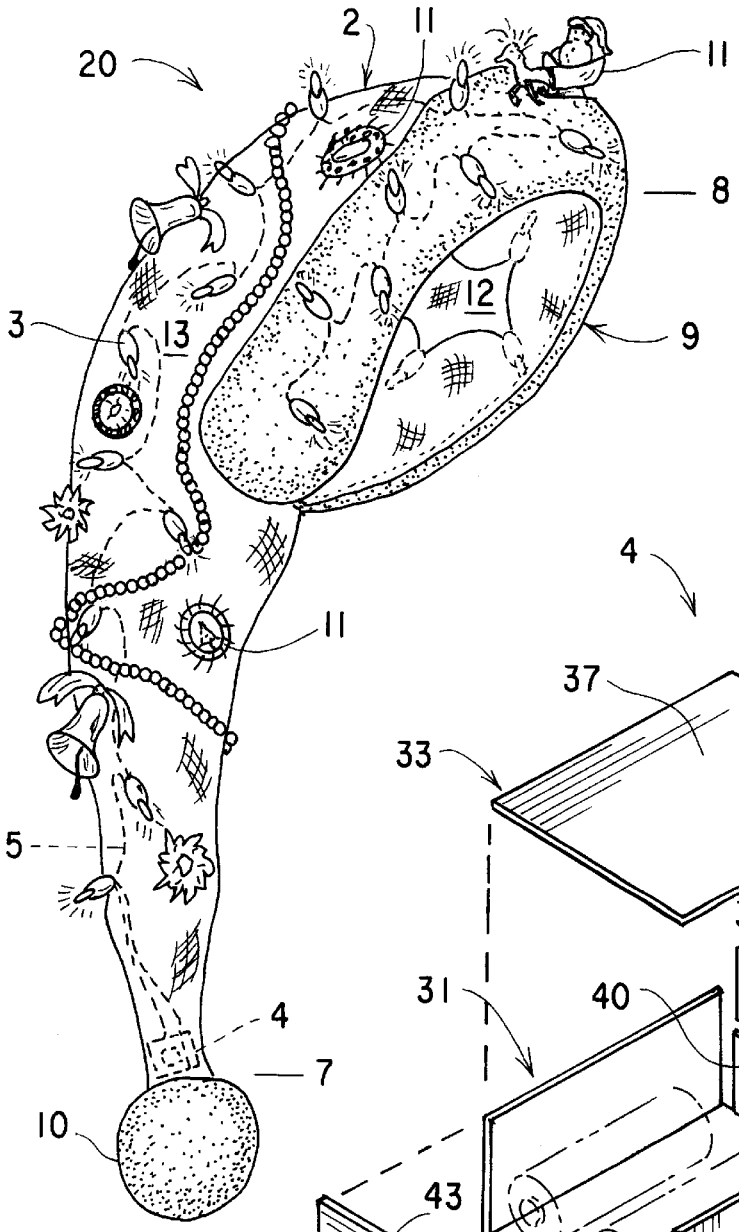
FIG. 2 is a perspective view of a preferred embodiment of the novelty hat.

The present invention is a novelty hat for displaying decorations. An environmental, elevational view of a decorative hat 1 according to a first preferred embodiment of the invention is shown in FIG. 1. FIG. 2 shows a perspective view of a decorative hat 20 according to a second preferred embodiment. Structural elements common to both embodiments are identified with common reference numerals.

The decorative hat of the present invention is generally defined by a body portion 2, a plurality of decorative lights 3, an electrical power supply 4, and electrical wiring 5. The body portion 2 may be formed from a flexible material like polyester fleece. As shown in FIG. 2, the body portion 2 may be formed in a cone-like shape. Alternatively, the body portion 2 may be formed from any one of a variety of known hat shapes.

The body portion 2 is further defined by a closed end 7 and an open end 8. A mouth 9 is formed around the open end 8 for fitting the body portion 2 around a person's head; whereas an ornament 10 may be attached to the closed end 7 for decorative purposes. According to one preferred embodiment, the ornament 10 is a cotton ball affixed to the closed end 7 by conventional stitching.

According to a preferred embodiment of the invention, a sack (not shown) may be formed around an inside surface of the mouth 9 for holding and concealing the power supply 4 inside the decorative hat of the present invention. Preferably, the sack (not shown) is cushioned to enable the decorative hat to be worn comfortably around a wearer's head with the power supply 4 positioned inside the sack (not shown).

The body portion is still further defined by an inside surface 12 and an outside surface 13. A variety of hanging decorative ornaments 11 may be attached to the body portion throughout the outside surface 13 to give the hat 1 a distinctive decorative appearance. For example, as shown in FIG. 2, a variety of conventional hanging Christmas ornaments may be attached to the outside surface 13 to give the hat 1 a distinctive Christmas season appearance. Preferably, the hanging decorative ornaments 11 are sewn or pinned onto the outside surface 13.

The plurality of decorative lights 3 are attached to the outside surface 13 for creating an illuminated decorative display on the outside surface 13 of the hat 1. Preferably, all of the decorative lights 3 are spaced relative to each other to cover a substantial portion of the outside surface 13 for creating an illuminated decorative display on a substantial portion of the outside surface 13. According to one preferred embodiment, the decorative lights 3 are conventional Christmas lights for creating an illuminated Christmas display on the outside surface 13. Alternatively, however, any well-known decorative lights substantially similar in size to conventional Christmas lights may be used.

The present invention also anticipates decorative illustrations being imprinted on the outside surface 13 by any well-known imprinting means to add further distinction to a decorative hat. For example, according to one preferred embodiment, conventional Christmas scenes (not shown) may be painted on the outside surface 13 to add further distinction to a decorative hat for the Christmas season. Alternatively, outrageous statements (not shown) relating to the Christmas season may be imprinted on the outside surface 13.

Figure 4:
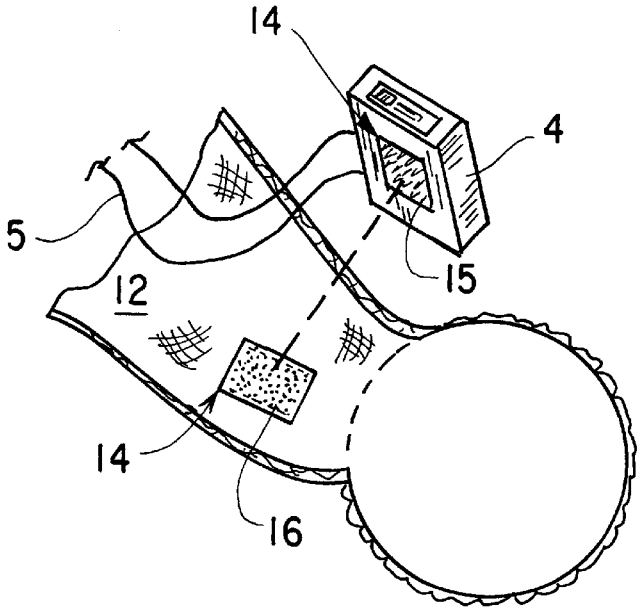
FIG. 4 is a detail view of the module contained inside the decorative hat.

As best shown in FIG. 4, the electrical power supply 4 may be attached to the inside surface 12 for concealing the power supply 4 from outside viewers of the decorative hat. According to one preferred embodiment, a first conventional piece of hook and loop fastener (Velcro™) 14 may be affixed to both the inside surface 12 and to the electrical power supply 4 for removably attaching the electrical power supply 4 to the body portion 2. Preferably, the velcro piece 14 is positioned near the closed end 7 for enabling the electrical power supply 4 to be stably supported near the closed end 7.

The first piece of Velcro 14 is preferably defined by a first male portion 15 and a first female portion 16. The first male portion 15 is adhesively attached to the power source 4 whereas the first female portion 16 is affixed to the inside surface 12. Any well-known adhesive layer (not shown) may be applied to one side of the first male portion 15 for enabling the first male portion 15 to be adhesively attached to the electrical power source 4. By contrast, the first female portion 16 may be affixed to the inside surface 12 by conventional stitching (not shown).

Figure 5:
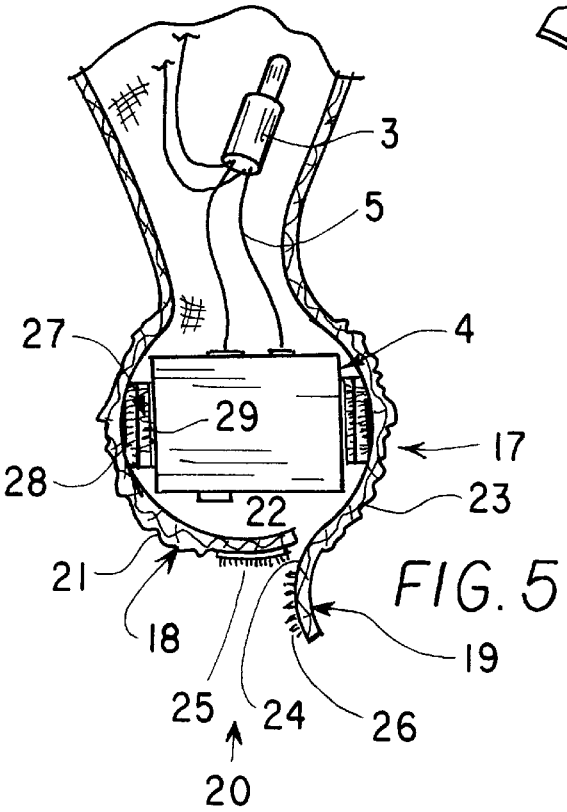
FIG. 5 is a detail view of the module attached to the inside of the decorative hat.

Alternatively, as shown in FIG. 5, a pouch 17 may be formed in the closed end 7 for enabling the electrical power supply 4 to be contained in the closed end 7. Preferably, the pouch 17 is formed by a first flexible layer 18 and a second flexible layer 19 for enabling the pouch 17 to be selectively opened to place the electrical power supply 4 in the pouch 17. The first flexible layer 18 is preferably defined by a first outer side 21 and a first inner side 22. Similarly, the second flexible layer 19 is preferably defined by a second outer side 23 and a second inner side 24.

A second piece of Velcro™ 20 may be affixed to both the first outer side 21 and the second inner side 24 for enabling the first flexible layer 18 to be releasably attached to the second flexible layer 19. More specifically, the second conventional piece of Velcro™ 20 may be defined by a second male portion 25 and a second female portion 26. The second male portion 25 is preferably sewn onto the first outer side 21 for affixing the second male portion 25 to the first outer side 21. Similarly, the second female portion 26 is preferably sewn onto the second inner side 24 for affixing the second female portion 26 to the second inner side 26.

A plurality of third conventional pieces of Velcro™ 27 may be affixed to both the electrical power supply 4 and the first inner side 22 and the second inner side 24 for releasably attaching the electrical power supply 4 to the pouch 17. More specifically, each of the plurality of third conventional pieces of Velcro™ has a third male portion 28 and a third female portion 29. Preferably, a third male portion 28 is separately sewn onto the first inner side 22 and the second inner side 23 for affixing each third male portion 28 to an inside of the pouch 17, whereas each third female portion 29 is adhesively attached to the electrical power supply 4 for enabling the electrically power supply 4 to be releasably attached to pouch 17 by the third male portion 28.

Each one of the plurality of decorative lights 3 is attached and electrically coupled to the electrical power supply 4 by the electrical wiring 5 for enabling electrical power to be supplied to the decorative lights. The electrical wiring 5 may be any well-known electrical wiring used for supplying electrical power to portable lighting systems.

According the first preferred embodiment, the electrical wiring 5 is attached to the inside surface 12 for concealing the electrical wiring 5 from viewers. The electrical wiring 5 may be passed through the body portion 2 at a plurality of locations by any well-known means and attached and electrically coupled to each one of the plurality of decorative lights 3 for enabling electrical power to be supplied to each of the decorative lights 3 from the electrical power supply 4.

Alternatively, according to the second preferred embodiment, the electrical wiring 5 may be attached to the outside surface 13. Except for the electrical wiring 5 being positioned on the outside surface 13 rather than the inside surface 12, the second preferred embodiment is practically identical to the first embodiment.

Figure 3:
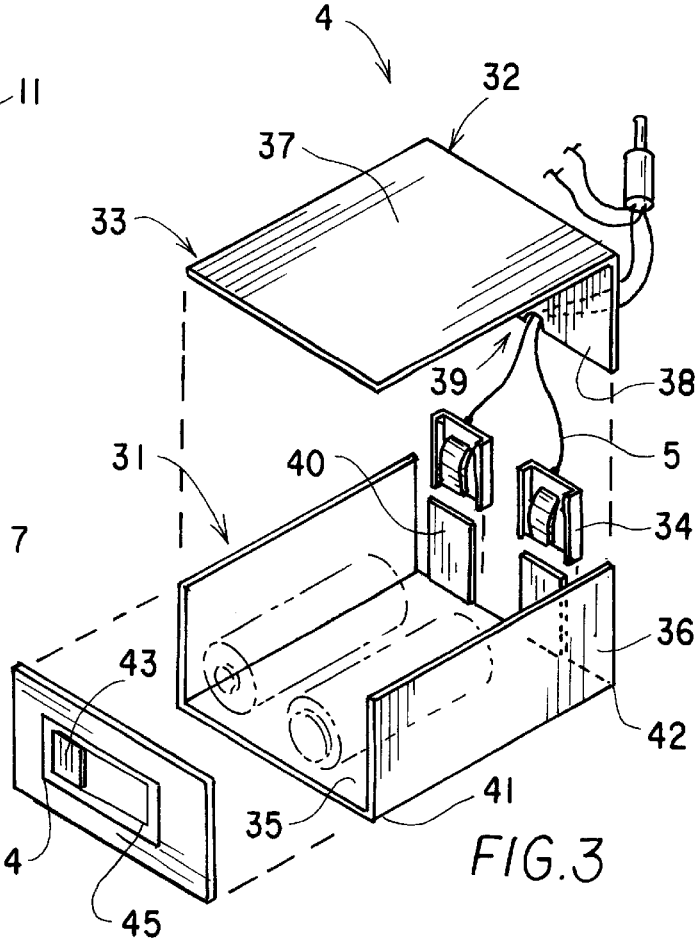
FIG. 3 is an exploded view of a module according to a preferred embodiment.

Further details relating to the electrical power supply 4 according to a preferred embodiment may best be appreciated by referring to FIG. 3. The electrical power supply 4 is preferably constructed of plastic material to make the electrical power supply 4 lightweight. Preferably, the electrical power supply 4 is a module formed by a base structure 31 having a front end 41 and a back end 42, a top structure 32, a lid structure 33, and two metal contacts 34. According to a preferred embodiment, the electrical power supply is 2⅝ inches in length, 2¼ inches in width, and 1⅛ inch in height.

The base structure 31 is preferably formed by a bottom wall 35, an intermediate wall 40, and two side walls 36. The intermediate wall 40 and the two side walls 36 each extend vertically upward from the bottom wall 35 for containing two conventional C-sized batteries within.

Preferably, two metal contacts 34 may be formed in the intermediate wall 40 for enabling electrical energy to be conducted to two C-sized batteries placed next to the intermediate wall 40. Each of the metal contacts 34 is preferably slidably attached to the intermediate wall 40 for enabling the metal contacts 34 to be selectively removed from the electrical power supply 4. Each of the two metal contacts 34 may be positioned approximately ⅝ inch from one of the two side walls 36 for enabling each metal contact 34 to contact a battery when two conventional C-sized batteries are inserted into the electrical power supply 4.

The electrical wiring 5 is attached and electrically coupled to each of the metal contacts 34 by any well-known electrical connector means for enabling electrical power to be supplied from the electrical power supply 4 to the plurality of decorative lights 3. Preferably, the electrical wiring 5 is routed underneath the concave indentation 39 and attached to each of the metal contacts 34 for permitting the electrical wiring to be conveniently routed through the back wall 38.

The top structure 32 may be formed by a top wall 37 and a back wall 38 extending vertically downward from the top wall 37. Preferably, a concave indentation 39 is formed in the bottom of the back wall 38 for enabling the electrical wiring 5 to be inserted through the back wall 38 to the inside of the electrical power supply 4.

Details relating to a preferred embodiment of the lid structure 33 will now be described. Preferably, the lid structure 33 is slidably attached to the base structure 31 for enabling the lid structure 33 to be selectively detached from the base structure 31. Accordingly, conventional C-sized batteries may be selectively inserted into the electrical power source 4 after detaching the lid structure 33 from the base structure 31. A conventional slot (not shown) may be formed in each of the two side walls 36 at the front end 41 for enabling the lid structure 33 to be slidably attached to the base structure 31.

As best shown in FIG. 3, a switching means 43 may be formed the lid structure 33 for enabling a user to selectively close the electrical circuit formed by the electrical wiring 5 contained inside the electrical power supply 4. Preferably, the switching means 43 is any well-known manual electrical switch that can slide between an OFF position 44 to an ON position 45 for enabling a user to manually open and close an electrical circuit to selectively turn the electrical power supply 4 off or on, respectively.

It is to be understood that the present invention is not limited to the sole embodiments described above, but encompasses any and all embodiments within the scope of the following claims.

I claim:

1. A decorative stocking hat comprising:

a body portion having a first end and a second end;

a mouth defining said first end for fitting over a person's head;

a pouch defining said second end;

first means for selectively opening and closing said pouch;

a module disposed inside said pouch;

switching means formed inside said module and having an ON position and an OFF position and actuable by moving said switching means from said OFF position to said ON position;

electrical circuitry enclosed in said module and connected to said switching means to become energized upon actuation of said switching means to said ON position; and a plurality of decorative lights attached to said body portion and electrically connected to said electrical circuitry to become illuminated upon energizing of the electrical circuitry.

2. The decorative stocking hat defined in claim 1, wherein said first means for selectively opening and closing the pouch comprises first and second flexible layers, each layer having a releasable fastener attached thereto.

3. The decorative hat defined in claim 2 further comprising a plurality of decorative ornaments attached to said body portion for decorating said body portion.

4. The decorative hat defined in claim 3, wherein said decorative ornaments are Christmas-related ornaments.

5. The decorative hat defined in claim 2, wherein said module comprises:

a container; and a cover removably coupled to said container for permitting access to the inside of said container.

6. The decorative hat defined in claim 5, wherein said cover is slidably attached to said container.

7. The decorative hat defined in claim 5, wherein said electrical circuitry is disposed in said container.

8. The decorative hat defined in claim 7, wherein said switching means is disposed in said cover.

9. The decorative hat defined in claim 8 further comprising:

at least one battery disposed in said container for energizing said electrical circuitry.

10. The decorative hat defined in claim 2 further comprising artwork imprinted on said body portion for decoration.

* * * * *